US009869512B1

(12) United States Patent
Gibbel

(10) Patent No.: US 9,869,512 B1
(45) Date of Patent: Jan. 16, 2018

(54) PULSE COMBUSTION VARIABLE RESIDENCE TIME DRYING SYSTEM

(71) Applicant: OMNIS THERMAL TECHNOLOGIES, LLC, Santa Barbara, CA (US)

(72) Inventor: David S. Gibbel, Santa Barbara, CA (US)

(73) Assignee: Omnis Thermal Technologies, LLC, Santa Barbara, CA (US)

( * ) Notice: Subject to any disclaimer, the term of this patent is extended or adjusted under 35 U.S.C. 154(b) by 0 days.

(21) Appl. No.: 15/355,928

(22) Filed: Nov. 18, 2016

(51) Int. Cl.

| | |
|---|---|
| ***F26B 3/08*** | (2006.01) |
| ***F26B 3/10*** | (2006.01) |
| ***F26B 17/10*** | (2006.01) |
| ***F26B 23/02*** | (2006.01) |
| ***F26B 25/14*** | (2006.01) |

(52) U.S. Cl.
CPC ..... *F26B 3/082* (2013.01); *F26B 3/10* (2013.01); *F26B 17/102* (2013.01); *F26B 23/026* (2013.01); *F26B 25/14* (2013.01)

(58) Field of Classification Search
CPC ..... F26B 3/082; F26B 3/10; F26B 17/102; F26B 23/026; F26B 25/14
USPC ..... 34/594
See application file for complete search history.

(56) References Cited

U.S. PATENT DOCUMENTS 3,592,395 A * 7/1971 Lockwood ..... A23L 3/50 159/DIG. 3
4,334,366 A * 6/1982 Lockwood ..... F26B 7/00 34/164
4,706,390 A * 11/1987 Kitchen ..... F26B 23/026 34/591
4,941,820 A * 7/1990 Lockwood, Jr. ..... F02G 1/02 34/191
4,974,336 A * 12/1990 Hahn ..... B29B 13/065 34/443

(Continued)

FOREIGN PATENT DOCUMENTS

GB 2360369 A * 9/2001 ..... G06F 9/505
WO WO 8503879 A1 * 9/1985 ..... A61M 1/3643

(Continued)

*Primary Examiner* — Stephen M Gravini
(74) *Attorney, Agent, or Firm* — Kirton McConkie; Evan R. Witt

(57) ABSTRACT

A variable residence time drying system for moist material includes a valveless pulse combustor and a drying chamber. The drying chamber includes a lower sidewall with an upward expanding configuration that defines a lower inverted partial cone, an upper sidewall with an upward contracting configuration, a lifting rotor disposed within the lower inverted partial cone to suspend material being dried within a shear/drying zone, an opening through which moist material is fed into the drying chamber, and an exit located at a top portion of the drying chamber through which dried material exits the drying chamber. The valveless pulse combustor produces drying gas and sonic vibrations that are introduced tangentially into the shear/drying zone. One or more cyclones receive dried material and collect small particles. The lifting rotor may rotate in a direction counter to a direction in which the heated drying gas is introduced into the drying chamber.

25 Claims, 6 Drawing Sheets

(56) References Cited

U.S. PATENT DOCUMENTS

| | | | | | |
|---|---|---|---|---|---|
| 4,992,043 | A * | 2/1991 | Lockwood, Jr. | F02G 1/02 | 110/347 |
| 5,136,793 | A * | 8/1992 | Kubotani | F26B 17/10 | 110/204 |
| 5,638,609 | A * | 6/1997 | Chandran | F26B 23/026 | 34/365 |
| 5,881,475 | A * | 3/1999 | Kishimoto | C02F 1/048 | 34/381 |
| 5,937,539 | A * | 8/1999 | Takahashi | F23C 3/00 | 34/191 |
| 7,024,800 | B2 * | 4/2006 | Carin | F26B 19/005 | 34/576 |
| 7,610,692 | B2 * | 11/2009 | Carin | F26B 23/022 | 34/388 |
| 7,685,737 | B2 * | 3/2010 | Gorbell | F26B 19/005 | 210/788 |
| 8,372,185 | B2 * | 2/2013 | Bullinger | B03B 4/06 | 209/133 |
| 8,756,826 | B2 * | 6/2014 | Gibbel | F26B 5/042 | 34/403 |
| 9,446,500 | B2 * | 9/2016 | Miller | B24C 7/0023 | |
| 2003/0145724 | A1 * | 8/2003 | Betting | B01D 45/16 | 95/29 |
| 2006/0101881 | A1 * | 5/2006 | Carin | C05F 3/00 | 71/21 |
| 2010/0300368 | A1 * | 12/2010 | Myers | A01K 1/0154 | 119/171 |

FOREIGN PATENT DOCUMENTS

| | | | | |
|---|---|---|---|---|
| WO | WO 8504002 | A1 * | 9/1985 | A61M 5/44 |
| WO | WO 2008127709 | A4 * | 4/2009 | B03B 4/06 |

* cited by examiner

PULSE COMBUSTION VARIABLE RESIDENCE TIME DRYING SYSTEM

BACKGROUND OF THE INVENTION

This disclosure relates to variable residence time drying systems, including drying systems adapted for drying biomass. The disclosed variable residence time drying system utilizes a valveless pulse combustor.

BACKGROUND

A need exists for an effective method of drying biomass materials such as manures, sewage sludge, paper pulp, and other biomass feedstocks, from an initial moisture content of about 70% by weight, down to a final moisture content of from about 12% to about 2% by weight.

Conventional state-of-the-art dryers typically subject all particles to the same temperature-time profile during drying. Conventional dryers may permit alteration of this time-temperature profile, but any alteration typically affects all particles equally.

Biomass feedstocks typically show great variation in natural particle size and constitution. Some particles are very small and tend to dry very quickly, while very large particles require a much longer time-at-temperature in order to dry efficiently.

Therefore a need exists for a dryer than can automatically apply a longer (as needed) drying time to large particles, while permitting small particles that dry rapidly to exit the system as soon as they are dried. It would be a further advancement to provide a variable residence time drying system that provides larger particles a longer drying residence time compared to smaller particles.

BRIEF SUMMARY OF THE INVENTION

This disclosure relates to variable residence time drying systems. The disclosed systems are particularly adapted to, but are not limited to, drying moist materials, including biomass, having an initial moisture content as high as 70% by weight.

The disclosed system utilizes a cyclonic vortex action to retain large, heavy, wet and dense particles within the drying vortex itself, while allowing small, light and dry particles to leave the drying region along with the discharged gas and water vapor. These fine particles are then separated from the gas phase in a conventional cyclone separator. Heavy particles that have experienced a longer residence time, and are acceptably dried, may be withdrawn in a 'heavies' stream, or left in the dryer until the natural comminuation which occurs reduces their size to the extent that they are exhausted with the fine particles and gases.

In this system, a first toroidal vortex of hot gas is created by tangentially introducing the products of combustion (PoC) from a valveless pulse combustor into a drying chamber. A second toroidal vortex rotating in opposite direction is created below the first vortex by a special mechanical lifting rotor. As these two vortices are rotating in opposite directions an intense ring-shaped shear zone occurs across the plane where the two vortices meet. This shear plane is also traversed by intense shock and blast waves superimposed on the hot gas stream issuing forth from the valveless pulse combustor.

One non-limiting variable residence time drying system includes a valveless pulse combustor or pulsejet configured to produce heated drying gas and sonic vibrations and to tangentially introduce the heated drying gas and sonic vibrations into a shear/drying zone of a drying chamber. The pulsejet provides heated drying gas in a high amplitude oscillating waveform with pressure waves cycling both above and below ambient pressure. The pulsejet sonic vibrations may range in frequency between about 15 Hz and 350 Hz and have a pressure amplitude between about 30 psig positive and 5 psig negative pressure. Thus, the pulsejet produces a pressure reversal both above and below ambient pressure.

It is within the scope of the disclosed invention to use dual pulsejets instead of one. Dual pulsejets, when coupled together in a fashion understood by those skilled in the art, tend to naturally lock into an out-of-phase operating mode wherein the combustors reinforce the pressure gain of each, resulting in a slightly higher total pressure rise for each.

The drying chamber includes a lower sidewall, an upper sidewall, a lifting rotor, an opening through which moist material is fed into the drying chamber, and an exit through which dried material exits the drying chamber, wherein the exit is located at a top portion of the drying chamber.

The lower sidewall of the drying chamber is configured with an upward expanding configuration. This configuration defines a lower inverted partial cone. In one non-limiting embodiment, the lower sidewall expands at a half-angle from a centerline axis in the range from 10° to 80°. In another embodiment, the lower sidewall expands at a half-angle from a centerline axis in the range from 40° to 50°.

The upper sidewall of the drying chamber is configured with an upward contracting configuration. This configuration defines an upper partial cone. In one non-limiting embodiment, the upper sidewall contracts at a half-angle from a centerline axis in the range from 10° to 80°. In another embodiment, the upper sidewall contracts at a half-angle from a centerline axis in the range from 40° to 50°.

A shear/drying zone is disposed between the lower inverted partial cone and the upper partial cone. In one non-limiting embodiment, the shear/drying zone is located at a region where a lower portion of the upper sidewall is joined to an upper portion of the lower sidewall. In one non-limiting embodiment, the shear/drying zone is located at a central cylindrical section disposed between the upper sidewall and the lower sidewall. In one embodiment, the drying chamber has a generally circular horizontal cross-sectional configuration.

In a non-limiting embodiment, the drying chamber includes an inverted cone located at the top portion of the drying chamber to restrict egress of insufficiently dried or insufficiently comminuted particles. The inverted cone is sized and configured to restrict egress of particles larger than about 200 μm.

The lifting rotor includes material lifting vanes that provide upward material and air flow as the lifting rotor rotates. The lifting rotor rotates in a direction counter to a direction in which the heated drying gas is introduced into the drying chamber. This counter rotation of the lifting rotor aids in breaking or comminuting larger particles of biomass into smaller particles. It also promotes intense turbulence and mixing so that there is good interaction between the moist particles and the heated drying gas. Smaller particles tend to dry quicker. In one embodiment, the lifting rotor has a tip speed at the end of the material lifting vanes in the range from about 100 ft/sec to about 1100 ft/sec. The rotor speed may be adjusted to control the operation of the drying chamber. If the rotor speed is too slow, material to be dried will tend to settle in the bottom of the dryer and merely be vigorously stirred rather than flung back up into suspension in the hot gas zone. It is desirable to maintain a gas-solid suspension of material to be dried within the hot gas vortex created in the upper section of the dryer by the tangential influx of high-velocity hot gas issuing from the pulsejet.

The variable residence time drying system preferably includes one or more cyclones connected to the drying chamber exit. The cyclones receive dried material. In one non-limiting embodiment, the cyclones are sized and configured to capture and remove dried particles. Depending upon the source material to be dried, the dried particles may have a particle size less than 10 μm, and typically in the range from 0.1 μm to 10 mm. The one or more cyclones preferably are configured to operate at a collection efficiency greater than 95% for 10 μm and greater sized particles. In one embodiment, the variable residence time drying system includes at least two cyclones. Additional cyclones can be provided to increase capacity. The reason for using dual or quad cyclones is because smaller cyclones are more efficient at capturing small particles. With smaller cyclones, it becomes necessary to use multiple units in parallel in order to achieve desired throughput while maintaining collection efficiency of particle sizes at and below 10 μm.

The opening through which moist material is fed into the drying chamber is preferably an airlock. The airlock enables most material to be introduced while maintaining the operating pressure within the drying chamber. In one non-limiting embodiment, the opening through which moist material is fed into the drying chamber is located relative to the pulsejet such that moist material is introduced into the drying chamber at a position such that shock waves from the pulsejet impinge directly upon the particles to be dried.

In operation, particles are subjected to drying conditions until they reach a state of small size and low density ('dryness') sufficient to permit egress from the drying chamber. This allows small particles that dry quickly to exit the system, while larger, wetter, or both, particles are subjected to a longer residence time sufficient to reduce their density to a suitable state of dryness.

The drying chamber functions to naturally classify particles, with two product streams being output: a 'heavies' dry product output and a 'fines' dry product output. These output streams may be kept as separate products, or may be recombined by mixing. In either event, the drying rate is enhanced because only those particles requiring an extended residence time receive such treatment. Particles exit the dryer as soon as they are dry.

The drying system can operate with a wide range of feedstocks, from dense solids to slurries and brines.

The natural action of this drying chamber also produces some comminuation of particles, which is desirable from a drying standpoint.

Because the drying system uses a pulse combustion heat and sonic energy source, the rate of drying is enhanced, which is of particular importance in drying materials which present a high diffusion barrier to moisture though the product. Pulse combustion permits drying at rates 200-300% higher than conventional steady-state drying technologies. Since pulse combustors operate at an equivalence ratio near or at 1.0, the total volume of gas discharged to the atmosphere is reduced compared to steady state combustors. In a combustion process, the equivalence ratio is the quotient of the actual air-fuel ratio divided by the stoichiometric air-fuel ratio. Steady state combustion typically requires an excess of air over that predicted by stoichiometry in order to achieve clean and efficient combustion. Pulse combustors are self-regulating devices that typically operate at an equivalence ratio of about 1.0 (stoichiometric ratio).

Because pulse combustors can combust finely-divided solid fuels, either alone or suspended in a carrier fluid, the dryer can operate using a low-cost fuel source such as powdered coal.

Because pulse combustors operate with enhanced combustion efficiency, hazardous air pollutant emissions, such as NOx, SOx and CO are greatly reduced compared to steady-state combustion systems.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The present embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the invention is not intended to limit the scope of the invention, as claimed, but is merely representative of present embodiments of the invention.

Reference is made to FIGS. 1-6 which illustrate a variable residence time drying system 10. The drying system 10 includes a variable residence time dryer 20, a valveless pulse combustor 30, and a separation cyclone 40.

Figure 3:
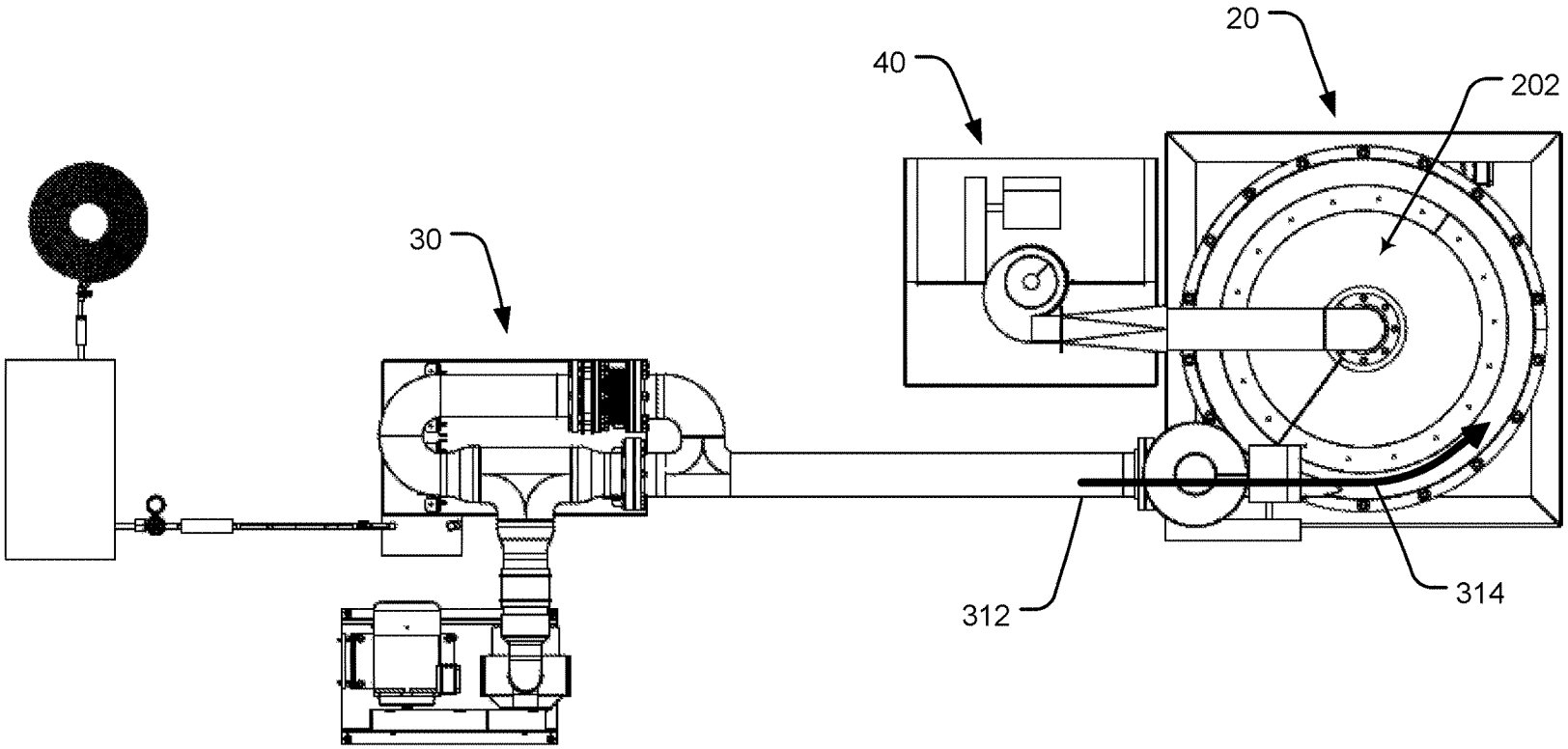
FIG. 3 shows a top plan view of the variable residence time dryer system of FIG. 1.

The variable residence time dryer 20 includes a drying chamber 202. The drying chamber includes a lower sidewall 204 having an upward expanding configuration that defines a lower inverted partial cone 206 and an upper sidewall 208 having an upward contracting configuration that defines an upper partial cone 210. The drying chamber 202 may have a generally circular horizontal cross-sectional configuration as seen in FIG. 3.

The shape of a cone may be defined based upon a half angle rotated about the cone's centerline axis. A small half angle would define a narrow cone, while a large half angle would define a broad cone. The total "spread" angle of the cone would be two times the half angle. In other words, the half angle from the cone's centerline is one half the cone's total spread angle. In the disclosed invention, the lower sidewall 204 expands at a half-angle from a centerline axis in the range from 10° to 80°. In one non-limiting embodiment, the lower sidewall 204 expands at a half-angle from a centerline axis in the range from 40° to 50°. Similarly, the upper sidewall 208 contracts at a half-angle from a centerline axis in the range from 10° to 80°. In one non-limiting embodiment, the upper sidewall 208 contracts at a half-angle from a centerline axis in the range from 40° to 50°.

A shear/drying zone 212 is disposed between the lower inverted partial cone 206 and the upper partial cone 210. It is within the shear/drying zone 212 that moist material is subjected to intense shearing forces and hot drying air. In one non-limiting embodiment, the shear/drying zone comprises a central cylindrical section 214 disposed between the upper sidewall and the lower sidewall. In another non-limiting embodiment a lower portion of the upper sidewall is joined to an upper portion of the lower sidewall.

A lifting rotor 216 is disposed within the lower inverted partial cone 206, configured to spin at a speed that suspends material being dried within the shear/drying zone 212. The shear/drying zone typically corresponds to the drying chamber's major diameter. In one non-limiting embodiment, this suspension is generated by a high-speed (800 RPM @ 54 inches diameter=188 ft/sec tip speed) lifting rotor disposed inside the lower inverted partial cone which serves to suspend the drying moist material in a toroidal vortex within the shear/drying zone 212. In one embodiment, the lifting rotor has a tip speed at the end of the material lifting vanes in the range from about 100 ft/sec to about 1100 ft/sec. The lifting rotor spins in a direction counter to the input direction of heated drying air produced by the valveless pulse combustor, as represented by arrow 217 in FIG. 6. The head-on impact between intense shock waves from the heated drying air and the counter-rotating moist material stream produces strong turbulence, shear, and mixing within the shear/drying zone 212.

Figure 4:
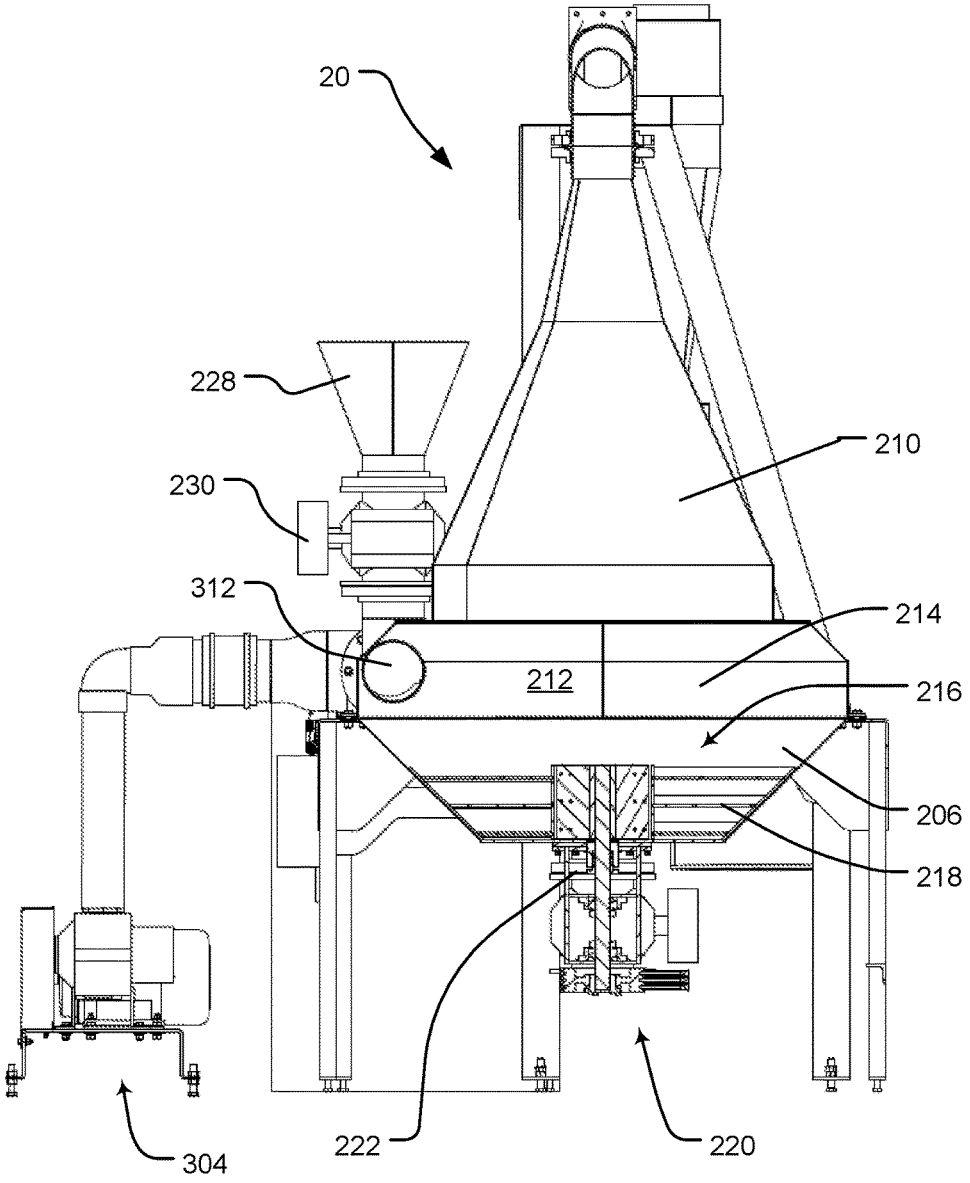
FIG. 4 shows a cross-sectional view of the variable residence time dryer taken along line A-A of FIG. 2.
Figure 5:
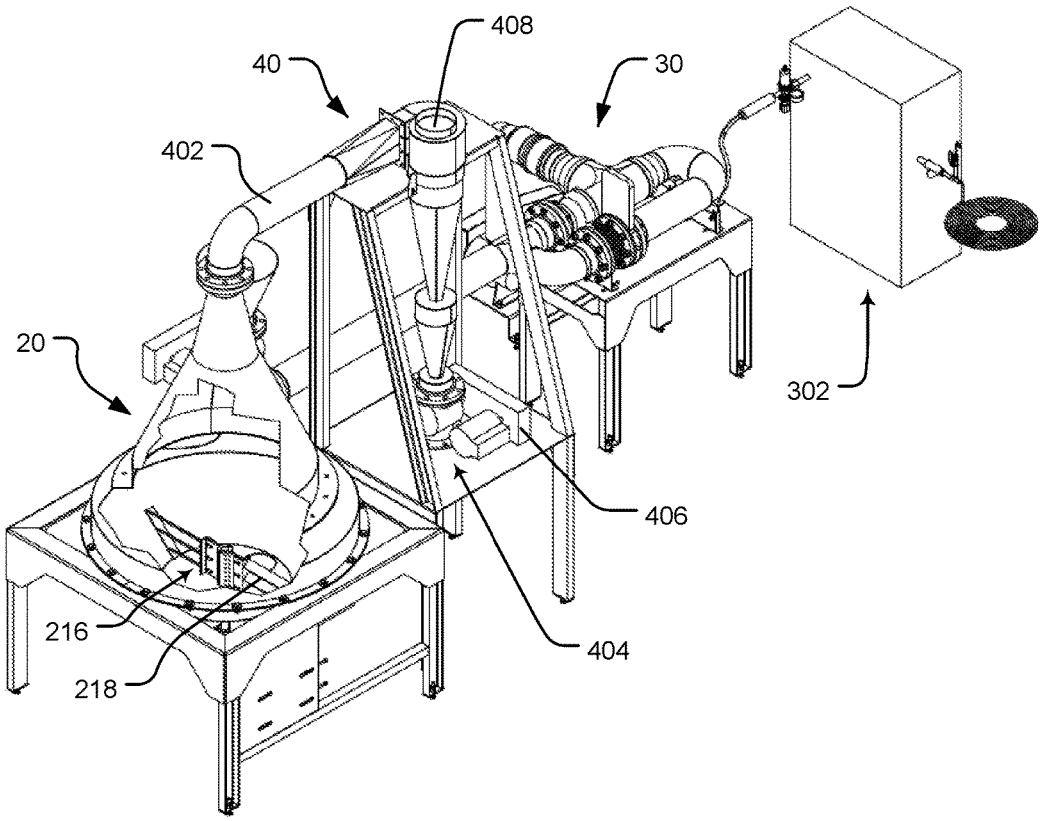
FIG. 5 shows a partial cut-away view of the variable residence time dryer.
Figure 6:
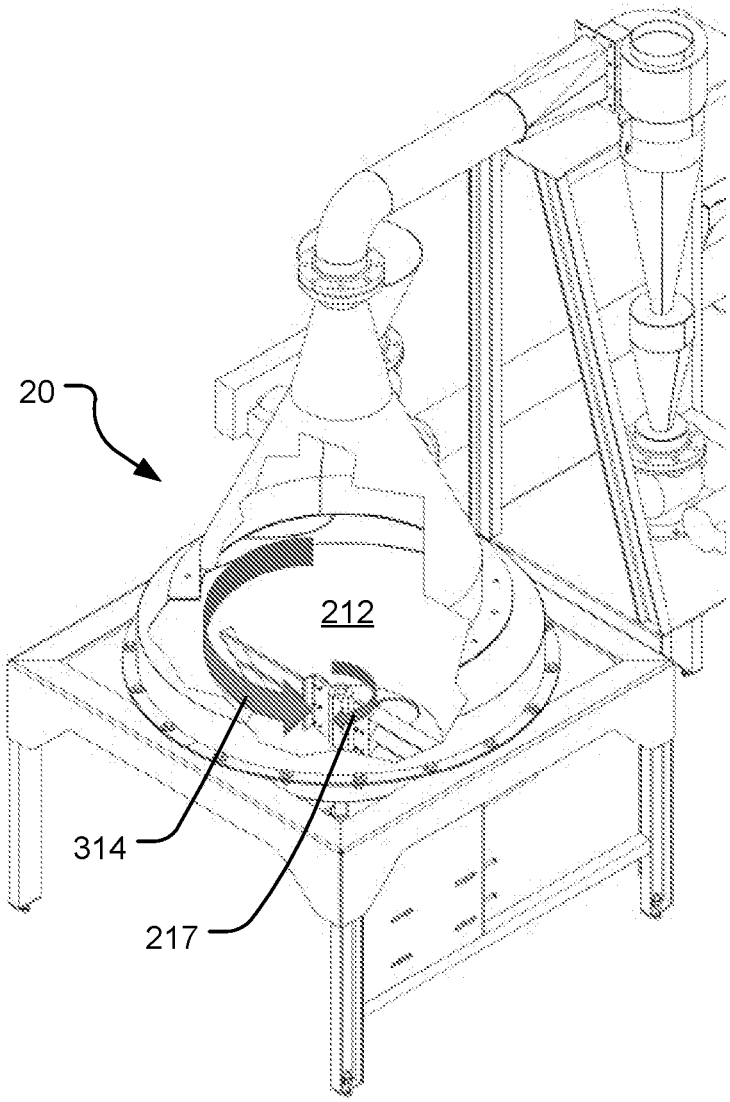
FIG. 6 shows a partial cut-away view of the variable residence time dryer and the direction of hot gas flow and the counter direction of the material lifting vanes of the lifting rotor.

In one disclosed embodiment, the lifting rotor includes a plurality of material lifting vanes 218 having variable lengths that conform to the upwardly expanding shape of the lower inverted partial cone 206. As shown in FIG. 4, material lifting vanes 218 disposed vertically closer to the shear/drying zone 212 have a longer length compared to material lifting vanes disposed near the bottom of the lower inverted partial cone 206. With a plurality of material lifting vanes 218, the lifting rotor operates three-dimensionally as opposed to operating in a two-dimensional plane as would a conventional single lifting vane or propeller. A plurality of material lifting vanes greatly enhances the suspension of solid materials in the shear/drying zone. It also increases the interaction between the solids and gases within the dryer. Without a plurality of material lifting vanes, some solids are lofted into the shear/drying zone, but some are merely stirred, depending upon the volumetric loading of the drying. In other words, if only a small amount of moist material is introduced into the dryer per unit time, then a conventional single vane rotor is suitable. However, one of the objectives of the disclosed dryer is to have a very small, compact dryer capable of processing a large amount of material in the minimum possible time. This reduces the capital and operating expenses, as well as the footprint. The disclosed dryer having multiple material lifting vanes is compact and capable of processing more material per unit time than would otherwise be the case with a single lifting vane.

A rotor drive assembly 220 provides rotational power to the lifting rotor and material lifting vanes. As shown in FIG. 4, the rotor drive assembly 220 may include a rotor drive motor 222 and a rotor drive belt 224 that connects the rotor drive motor to the lifting rotor. A positive pressure shaft seal 226 is provided to prevent dried material leakage and damage to the bearing assembly of the rotor drive unit 220. The rotor speed is governed by the rotor drive assembly, which may be adjusted to control the operation of the drying chamber based upon the characteristics of the moist material being dried and the desired moisture content of the dried material.

A moist material input hopper 228 is provided to introduce moist material into the drying chamber 202. The variable residence time dryer 20 operates at a positive pressure. A material input airlock 230 is provided to enable the moist material to be introduced into the pressurized drying chamber.

Figure 1:
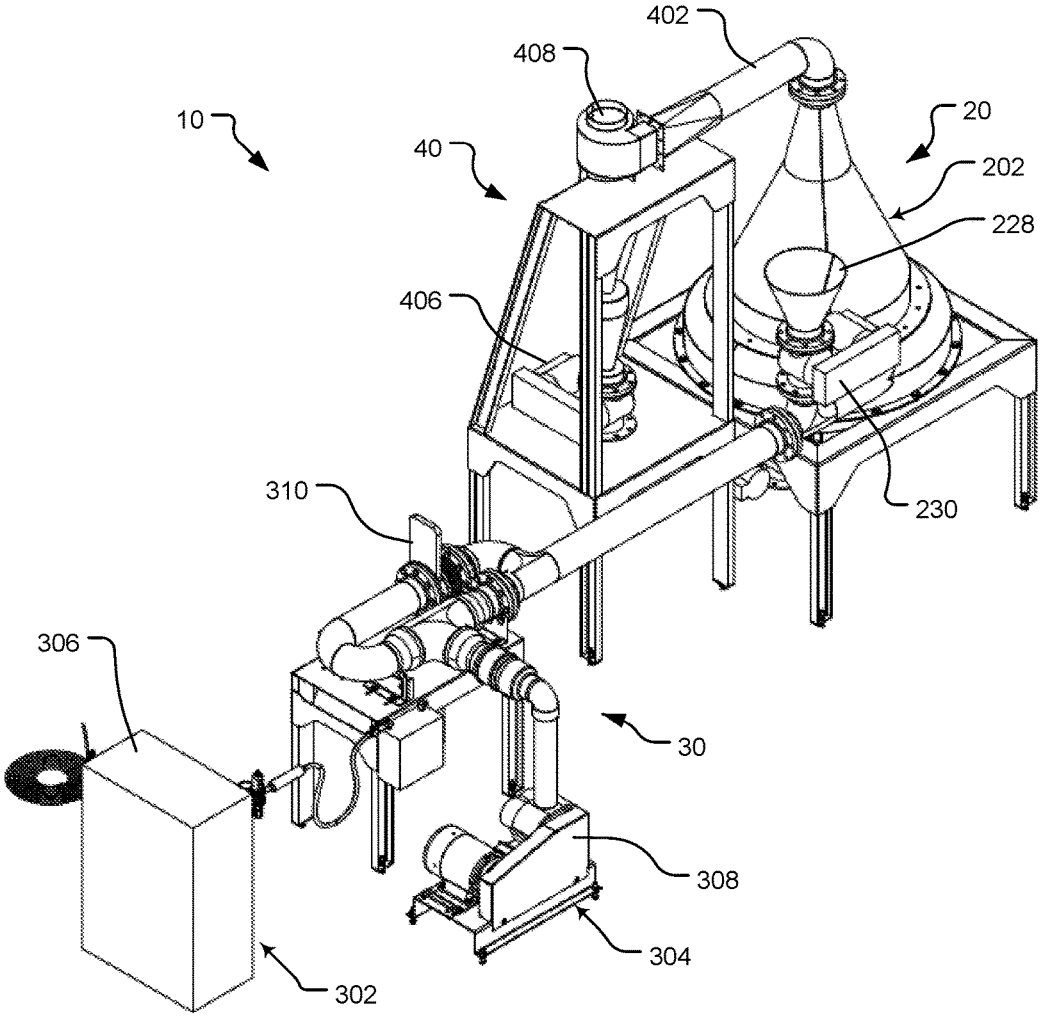
FIG. 1 shows a variable residence time dryer system within the scope of the disclosed invention.
Figure 2:
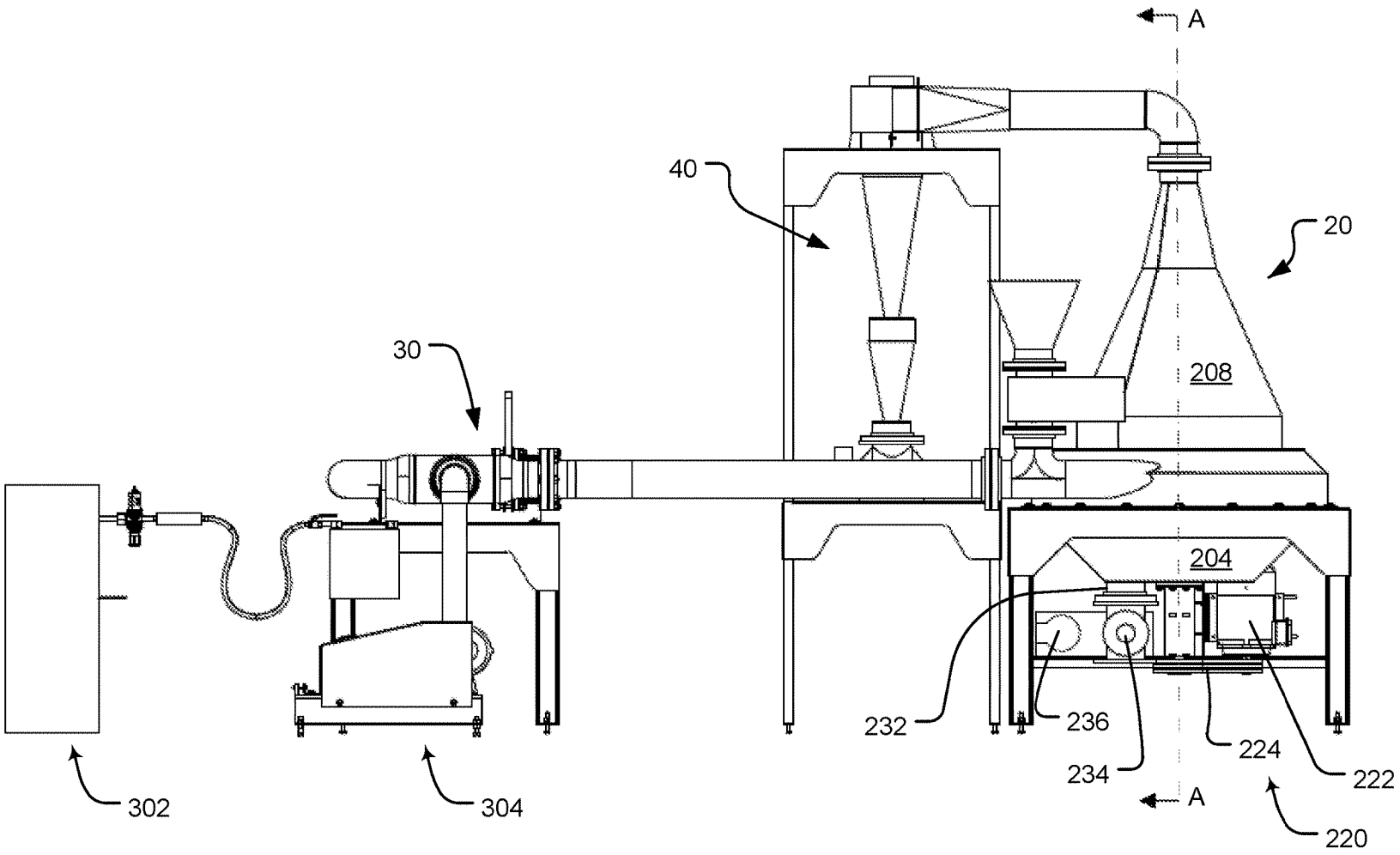
FIG. 2 shows a side elevation view of the variable residence time dryer system of FIG. 1.

As shown in FIG. 2, a heavies discharge port 232 prevents accumulation of rocks, nails and other undesirable materials in the dryer 20, as well as removal of larger sized dried material. The heavies discharge port is located at the bottom of the lower inverted partial cone 206 defined by the lower sidewall 204. A heavies discharge airlock 234 is provided for removal of the heavies material from the pressurized drying chamber. A heavies airlock drive motor and gearbox 236 controls operation of the heavies discharge airlock and removal of material via the heavies discharge port. The heavies discharge timing rate is variable. Thus, the ratio of heavies to fines discharge is also adjustable.

The disclosed variable residence time drying system 10 uses a valveless pulse combustor 30 firing directly against a rotating toroid of moist material suspended in hot gas. The valveless pulse combustor 30 provides heated drying gas in a high amplitude oscillating wave form with pressure waves cycling both above and below ambient pressure. These oscillating pressure pulses enhance the rate of drying moist material. Various valveless pulse combustors are known and commercially available. The valveless pulse combustor will typically operate according to the principles disclosed in U.S. Pat. No. 3,462,955 to Lockwood. In one non-limiting embodiment, the valveless pulse combustor has a linear shape instead of the U-shaped configuration disclosed by Lockwood.

Pulse combustion permits drying at rates 4-10 times faster than conventional steady-state drying technologies. Without being bound by theory, the improved drying rate using pulse combustion results from oscillating shock waves and pressure reversals which enhance heat transfer and moisture removal compared to conventional steady state combustion. A typical operating pulse frequency may range from about 15 Hz to about 350 Hz. In one embodiment, the operating pulse frequency is about 88±5 Hz.

The valveless pulse combustor may be operated in a combustion-air only mode, such that it does not require a large percentage of excess oxygen, as is the case in steady state combustors. This allows the moist material to be dried by exposure to heated drying gas containing less than 5% by volume oxygen, which is too low to permit combustion or ignition of the material being dried. The disclosed valveless pulse combustion also reduces the total volume of air discharged to the atmosphere, since valveless pulse combustors operate at an equivalence ratio near or at 1.0.

The valveless pulse combustor 30 requires a fuel source 302 and an oxygen or air source 304. Yet another advantage of using a valveless pulse combustor is the ability to combust finely-divided solid fuels, either alone or suspended in a carrier fluid. Thus, the valveless pulse combustor dryer can operate using a low-cost fuel source such as powdered coal. The powdered coal may be suspended in a carrier fluid. The carrier fluid may be inert or reactive. The carrier fluid may be liquid or gas. One possible carrier fluid is water. The carrier fluid may optionally be a fuel source itself, such as natural gas, diesel, or another combustible liquid or gaseous fuel. The carrier fluid may optionally contain an oxidizing agent, such as air or oxygen. In one non-limiting embodiment, the fuel source 302 includes a source of gaseous hydrocarbon fuel, such as natural gas, propane, butane, etc. In a non-limiting embodiment and shown in the figures, the fuel source 302 includes a propane vaporizer 306. In one non-limiting embodiment, the oxygen or air source 304 includes an air pump positive displacement blower 308. A gate valve 310 may be provided for controlling bypass air.

In one non-limiting embodiment, the heated drying gas produced by the valveless pulse combustor 30 has a temperature of about 700° C.±50° C. The heated drying gas is preferably introduced into the shear/drying zone 212 of the drying chamber 202 tangentially 312 as shown by the arrow 314 in FIGS. 4 and 6.

As disclosed above, the drying chamber 202 has an upper partial cone 210 above the shear/drying zone 212. This geometry serves to create a 'dead' or low velocity region in the center of the drying chamber which allows heavy wet particles to return to the bottom center of the lifting rotor 216 where they are flung up and outward, for another 'circuit' through the shear/drying zone. Smaller and drier particles are able to remain suspended in the mass of air that travels through the drying chamber, and these 'dried' particles are carried upward to the higher velocity region of the dryer 20 whereby they are entrained and carried out of the system, either to be removed in the separation cyclone 40, or if they are generally smaller than 5 microns, to be collected in a baghouse filter, electrostatic precipitator, wet scrubber or other collection device.

The separation cyclone 40 receives and process system exhaust gas 402 exiting the dryer 20. The separation cyclone is designed and configured to capture and remove fine particles, typically in the range from about 1 μm to about 3 mm. In some embodiments, the separation cyclone dust collector may capture fine particles as small as 10 μm with an efficiency of 99.9%. The captured fine particles are discharged through a dried material discharge 404 disposed below a dried material discharge airlock 406. A steam discharge outlet 408 at the top of the separation cyclone 40 enables steam to be discharged to a stack or to the atmosphere. There may also be an optional stack silencer to minimize noise. Multiple separation cyclones may be connected in series to expand the capacity of the drying system.

The following non-limiting example is given to illustrate operation of a variable residence time drying system within the scope of the disclosed invention. It is to be understood that this example is neither comprehensive nor exhaustive of the many types of embodiments which can be practiced in accordance with the presently disclosed invention.

EXAMPLE 1

In this example, the feed material to be dried included horse manure with included bedding (primarily wood shavings but also including some straw) at a moisture content of 48 weight percent water. The final dried target moisture content was less than 12 wt. % water.

The wet horse manure was fed into a variable residence time drying system as disclosed herein and illustrated in the figures. The moist material was introduced into the drying system via the moist material input hopper and material input airlock at a rate of 800 pounds per hour. The already fine material was instantaneously flash-dried in the drying chamber. The residence time of already fine material within the drying chamber is believed to be on the order of milliseconds. Heavier, wetter and larger material took advantage of the variable residence time feature of the dryer had a residence time believed to be on the order several seconds or more. Material that was too large or heavy (rocks and nails and such) to be carried over to the product recovery separation cyclone had a residence that was solely dependent upon the timing of the heavies discharge port and airlock.

For example, while the dried material discharge airlock is run continuously, the heavies discharge airlock is only turned on intermittently in order to prevent accumulation of rocks and other non-product materials, since if allowed to accumulate such non-desirable materials would eventually foul the drying chamber and possibly inhibit operation of the dryer. In one experiment, the heavies airlock was energized for 15 seconds once every minute. At this ratio of 'ON' time to 'OFF' time, the mass ratio of fines to heavies produced by the system was approximately three-to-one. The interior of the dryer remained completely clean, and the 'OFF' time could have been significantly lengthened. It is envisioned that the heavies discharge port may be operated as infrequently 30 seconds 'ON' for every 10 to 30 minutes or longer 'OFF'. This frequency of periodic discharge of heavies need only be sufficient to prevent massive accumulation of heavies such that the entire chamber is so occluded with heavy material so as to inhibit or prevent normal airflow through the dryer. This ratio is also highly dependent upon the constituent make-up of the product to be dried.

Post-processing in the variable residence time dryer, the moisture contents of the heavies and fines product streams were measured using an infrared moisture analyzer. Final moisture content of the fines was 1.3% water (by weight) and the heavies moisture was 7.6 wt. % water, both well within the limits of acceptance (<12 wt. % water) for this process. The heavies discharge consisted primarily of large wood chips, while the fines discharge consisted mostly of very fine powder, with some long fibers and bits of straw. Large wood chips present a significant barrier to diffusion of moisture from the interior of the wood piece as compared to fine powders and fibers, thus the higher final moisture is understandable in this context. In either case, both final moisture contents are below target, and the two product streams may be recombined, or used separately, whichever is more desirable for the intended ultimate use. In this way, heavy materials that would otherwise be unable to be flash dried in the range of milliseconds as is affordable by the use of pulse combustion drying, are able to benefit from a slightly longer residence time in the dryer until such time as they are light and fluffy enough to be carried over to the product separation cyclone, and thus all materials are automatically dried in the minimum possible time.

From the foregoing description, it will be appreciated that the disclosed invention provides an efficient and rapid system and method for drying moist material feedstocks. The disclosed invention further provides a drying process that provides a variable residence time drying system based upon the moist material particle size. Larger particles experience a longer drying residence time compared to smaller particles. The variable residence time drying process combined with the use of pulse combustion provides a high-speed drying system adapted to a variety of moist materials.

The described embodiments and examples are all to be considered in every respect as illustrative only, and not as being restrictive. The scope of the invention is, therefore, indicated by the appended claims, rather than by the foregoing description. All changes that come within the meaning and range of equivalency of the claims are to be embraced within their scope.

The invention claimed is:

1. A variable residence time drying system comprising:

a drying chamber comprising:

a lower sidewall, wherein the lower sidewall has an upward expanding configuration that defines a lower inverted partial cone;

an upper sidewall, wherein the upper sidewall has an upward contracting configuration that defines an upper partial cone;

a shear/drying zone disposed between the lower inverted partial cone and the upper partial cone;

a lifting rotor disposed within the lower inverted partial cone, configured to spin at a speed that suspends material being dried within the shear/drying zone;

an opening through which moist material is fed into the drying chamber; and an exit through which dried material exits the drying chamber, wherein the exit is located at a top portion of the drying chamber; and a pulsejet configured to produce heated drying gas and sonic vibrations and to tangentially introduce the heated drying gas and sonic vibrations into the shear/drying zone of the drying chamber.

2. The variable residence time drying system according to claim 1, wherein the lifting rotor spins in a direction counter to tangentially introduced heated drying gas.

3. The variable residence time drying system according to claim 1, wherein the lifting rotor comprises a plurality of lifting vanes.

4. The variable residence time drying system according to claim 1, wherein the lower sidewall expands at a half-angle from a centerline axis in the range from 10° to 80°.

5. The variable residence time drying system according to claim 1, wherein the lower sidewall expands at a half-angle from a centerline axis in the range from 40° to 50°.

6. The variable residence time drying system according to claim 1, wherein the upper sidewall contracts at a half-angle from a centerline axis in the range from 10° to 80°.

7. The variable residence time drying system according to claim 1, wherein the upper sidewall contracts at a half-angle from a centerline axis in the range from 40° to 50°.

8. The variable residence time drying system according to claim 1, wherein the drying chamber has a generally circular horizontal cross-sectional configuration.

9. The variable residence time drying system according to claim 1, wherein the shear/drying zone comprises a central cylindrical section disposed between the upper sidewall and the lower sidewall.

10. The variable residence time drying system according to claim 1, wherein the lifting rotor rotates in a direction counter to a direction in which the heated drying gas is introduced into the drying chamber.

11. The variable residence time drying system according to claim 1, further comprising one or more cyclones connected to the drying chamber exit to receive dried material and collect particles.

12. The variable residence time drying system according to claim 11, comprising at least two cyclones.

13. The variable residence time drying system according to claim 11, wherein the one or more cyclones operate at a collection efficiency greater than 95%.

14. The variable residence time drying system according to claim 1, wherein the lifting rotor has a tip speed in the range from about 100 ft/sec to about 1100 ft/sec.

15. The variable residence time drying system according to claim 1, wherein the opening through which moist material is fed into the drying chamber comprises an airlock.

16. The variable residence time drying system according to claim 1, wherein the opening through which moist material is fed into the drying chamber is located relative to the pulsejet to introduce moist material into the drying chamber to receive shock waves from the pulsejet.

17. The variable residence time drying system according to claim 1, wherein the moist material is biomass material.

18. A variable residence time drying system comprising:

a drying chamber having a generally circular horizontal cross-sectional configuration comprising:

a lower sidewall, wherein the lower sidewall has an upward expanding configuration that defines a lower inverted partial cone;

an upper sidewall, wherein the upper sidewall has an upward contracting configuration that defines an upper partial cone;

a central cylindrical section disposed between the upper partial cone and the lower inverted partial cone, wherein the central cylindrical section defines a shear/drying zone;

a lifting rotor disposed within the lower inverted partial cone comprising a plurality of lifting vanes, wherein the lifting rotor is configured to rotate at a speed that suspends material being dried within the shear/drying zone;

a pulsejet configured to produce heated drying gas and sonic vibrations and to tangentially introduce the heated drying gas and sonic vibrations into the shear/drying zone of the drying chamber, wherein the lifting rotor rotates in a direction counter to a direction in which the heated drying gas is introduced into the drying chamber;

an opening through which moist material is fed into the drying chamber, wherein the opening is located relative to the pulsejet to introduce moist material into the drying chamber to receive shock waves from the pulsejet; and an exit through which dried material exits the drying chamber, wherein the exit is located at a top portion of the drying chamber.

19. The variable residence time drying system according to claim 18, wherein the lower sidewall expands at a half-angle from a centerline axis in the range from 10° to 80°.

20. The variable residence time drying system according to claim 18, wherein the lower sidewall expands at a half-angle from a centerline axis in the range from 40° to 50°.

21. The variable residence time drying system according to claim 18, wherein the upper sidewall contracts at a half-angle from a centerline axis in the range from 10° to 80°.

22. The variable residence time drying system according to claim 18, wherein the upper sidewall contracts at a half-angle from a centerline axis in the range from 40° to 50°.

23. The variable residence time drying system according to claim 18, further comprising one or more cyclones connected to the drying chamber exit to receive dried material and collect particles having a size less than or equal to 10 μm.

24. The variable residence time drying system according to claim 18, wherein the opening through which moist material is fed into the drying chamber comprises an airlock.

25. The variable residence time drying system according to claim 18, wherein the moist material is biomass material.

* * * * *